US011504937B2

(12) United States Patent
Cheich et al.

(10) Patent No.: US 11,504,937 B2
(45) Date of Patent: Nov. 22, 2022

(54) LOW COST MANUAL EXPANDING-DUNNAGE CONVERSION APPARATUS

(71) Applicant: Ranpak Corp., Concord Township, OH (US)

(72) Inventors: Robert C. Cheich, Independence, OH (US); Dennis J. Wagner, Painesville, OH (US)

(73) Assignee: Ranpak Corp., Concord Township, OH (US)

( * ) Notice: Subject to any disclaimer, the term of this patent is extended or adjusted under 35 U.S.C. 154(b) by 301 days.

(21) Appl. No.: 15/763,885

(22) PCT Filed: Aug. 16, 2016

(86) PCT No.: PCT/US2016/047139
§ 371 (c)(1),
(2) Date: Mar. 28, 2018

(87) PCT Pub. No.: WO2017/074535
PCT Pub. Date: May 4, 2017

(65) Prior Publication Data

US 2018/0281336 A1 Oct. 4, 2018

Related U.S. Application Data

(60) Provisional application No. 62/247,298, filed on Oct. 28, 2015.

(51) Int. Cl.
*B31D 5/00* (2017.01)
*B65H 23/14* (2006.01)
*B65H 16/00* (2006.01)

(52) U.S. Cl.
CPC ..... *B31D 5/0065* (2013.01); *B65H 16/005* (2013.01); *B65H 23/14* (2013.01);
(Continued)

(58) Field of Classification Search
CPC ..... B31D 5/0065; B31D 2205/0023; B31D 2205/0047; B31D 2205/0064;
(Continued)

(56) References Cited

U.S. PATENT DOCUMENTS 1,344,826 A * 6/1920 Sexton ..... B31D 1/0031 162/114
1,850,543 A * 3/1932 Gersman ..... B21D 31/046 29/6.1
(Continued)

FOREIGN PATENT DOCUMENTS

CN 1134687 A 10/1996
CN 101917890 A 12/2010
(Continued)

OTHER PUBLICATIONS

First Chinese Office Action for corresponding patent application No. 201680063170.1, dated Apr. 18, 2019.
(Continued)

*Primary Examiner* — Sameh Tawfik
(74) *Attorney, Agent, or Firm* — Renner, Otto, Boisselle & Sklar, LLP

(57) ABSTRACT

A manually-operated dunnage conversion apparatus includes a housing with an outlet opening, a supply of slit sheet stock material supported within the housing for dispensing from the outlet opening, and a pair of opposed expansion members rotatably coupled to the housing for rotation about respective, parallel expansion axes between the supply and the outlet opening. The expansion members are biased towards each other via a biasing member to provide a gripping force on sheet stock material fed therebetween to apply friction to the sheet stock material that causes the sheet stock material to expand in length and thickness as an operator pulls the sheet stock material from the outlet opening in the housing. With the possible excep-
(Continued)

tion of the biasing member, the apparatus may be made of paper-based products, making the apparatus recyclable, reusable, and composed of a renewable resource, as well as inexpensive to manufacture.

16 Claims, 13 Drawing Sheets

(52) U.S. Cl.
CPC ..... *B31D 2205/007* (2013.01); *B31D 2205/0023* (2013.01); *B31D 2205/0047* (2013.01); *B31D 2205/0064* (2013.01); *B31D 2205/0082* (2013.01); *B65H 2301/4127* (2013.01); *B65H 2301/5124* (2013.01); *B65H 2404/1451* (2013.01); *B65H 2404/1452* (2013.01); *B65H 2701/1944* (2013.01)

(58) Field of Classification Search
CPC ..... B31D 2205/007; B31D 2205/0082; B65H 61/005; B65H 23/14; B65H 2301/4127; B65H 2301/5124; B65H 2404/1451; B65H 2404/1452; B65H 2701/1944
USPC ..... 493/350
See application file for complete search history.

(56) References Cited

U.S. PATENT DOCUMENTS

| | | | | | |
|---|---|---|---|---|---|
| 2,848,104 | A * | 8/1958 | Schor | B65D 85/672 | 206/391 |
| 3,162,942 | A * | 12/1964 | Christman | B21D 31/046 | 29/455.1 |
| 3,302,781 | A * | 2/1967 | Rudnick | B65H 35/0006 | 206/391 |
| 3,854,975 | A * | 12/1974 | Brenneman | G03G 15/2092 | 430/124.23 |
| 4,531,634 | A * | 7/1985 | Jung-Chi | A44B 18/00 | 206/346 |
| 5,412,853 | A * | 5/1995 | Catallo | D06C 21/00 | 26/18.6 |
| 5,538,778 | A * | 7/1996 | Hurwitz | B31C 5/00 | 206/521 |
| 5,667,871 | A | 9/1997 | Goodrich et al. | | |
| 5,688,578 | A * | 11/1997 | Goodrich | B31D 3/002 | 428/136 |
| 5,738,175 | A * | 4/1998 | Alhamad | B21D 31/04 | 169/46 |
| 5,782,735 | A | 7/1998 | Goodrich et al. | | |
| 5,910,079 | A * | 6/1999 | Watanabe | B31D 5/006 | 493/352 |
| 6,776,366 | B2 * | 8/2004 | Tschesche | B02C 4/42 | 100/168 |
| 9,376,280 | B2 * | 6/2016 | Page | B65H 23/06 | |
| 9,505,574 | B2 * | 11/2016 | Kuchar | B65H 16/005 | |
| 9,546,060 | B2 * | 1/2017 | Tashiro | B65H 5/068 | |
| 9,688,044 | B2 * | 6/2017 | Deis | B65D 81/127 | |
| 9,701,091 | B2 * | 7/2017 | Page | B31D 5/0065 | |
| 9,902,551 | B2 * | 2/2018 | Krook | A61F 13/64 | |
| 9,963,283 | B2 * | 5/2018 | Page | B31D 5/0065 | |
| 10,226,907 | B2 * | 3/2019 | Goodrich | B32B 3/266 | |
| 2009/0140001 | A1 | 6/2009 | Lewis et al. | | |
| 2012/0035038 | A1 | 2/2012 | Lembach | | |
| 2013/0272756 | A1 * | 10/2013 | Nagata | G03G 15/2053 | 399/323 |
| 2014/0027553 | A1 * | 1/2014 | Page | B65H 16/005 | 242/159 |
| 2015/0122866 | A1 * | 5/2015 | Kuchar | B31D 1/0031 | 226/195 |
| 2015/0140265 | A1 | 5/2015 | Page et al. | | |
| 2016/0130104 | A1 | 5/2016 | Page et al. | | |

FOREIGN PATENT DOCUMENTS

| | | | |
|---|---|---|---|
| CN | 103153600 | A | 6/2013 |
| DE | 29506078 | U1 | 9/1995 |
| DE | 19911628 | A1 | 9/2000 |
| EP | 0768948 | | 4/1997 |
| EP | 0978372 | A2 | 9/2000 |
| JP | H09-502410 | A | 3/1997 |
| JP | H09-110290 | A | 4/1997 |
| JP | 2011-131912 | A | 7/2011 |
| WO | 9507225 | A2 | 3/1995 |
| WO | 9601731 | A1 | 1/1996 |
| WO | 9624540 | A1 | 8/1996 |
| WO | 2014014905 | A1 | 1/2014 |
| WO | 2015103251 | A1 | 7/2015 |
| WO | 2016077728 | A1 | 5/2016 |
| WO | 2016137740 | A1 | 9/2016 |
| WO | 2017039792 | A1 | 3/2017 |
| WO | 2017074535 | A1 | 5/2017 |

OTHER PUBLICATIONS

First Japanese Office Action for corresponding patent application No. 2018 520483, dated May 7, 2019.
First Australian Examination Report for corresponding patent application No. 2016343891, dated May 8, 2019.
Written Opinion of the International Searching Authority for International Application No. PCT/US2016/047139.
Second Written Opinion of the International Searching Authority for International Application No. PCT/US2016/047139.
Examination Report dated Feb. 25, 2020 for related Indian Application No. 201817014153.

* cited by examiner

LOW COST MANUAL EXPANDING-DUNNAGE CONVERSION APPARATUS

RELATED APPLICATIONS

This application is a national phase of International Application No. PCT/US2016/047139 filed Aug. 16, 2016 and published in the English language, and which claims priority to U.S. Application No. 62/247,298 filed Oct. 28, 2015, which are each hereby incorporated herein by reference in their entireties.

FIELD OF THE INVENTION

This invention relates generally to a dunnage conversion apparatus and method for converting a sheet stock material into a dunnage product, and more particularly to a dunnage conversion apparatus and method that expands a pre-slit sheet stock material.

BACKGROUND

In the process of shipping one or more articles from one location to another, a packer typically places some type of dunnage material in a shipping container, such as a cardboard box, along with the article or articles to be shipped. The dunnage material typically is used to wrap the articles or to partially or completely fill the empty space or void volume around the articles in the container. By filling the void volume, the dunnage prevents or minimizes movement of the articles that might lead to damage during the shipment process. The dunnage also can perform blocking, bracing, or cushioning functions. Some commonly used dunnage materials are plastic foam peanuts, plastic bubble pack, air bags, and converted paper dunnage material.

Unlike most plastic dunnage products, converted paper packing material is an ecologically-friendly packing material that is recyclable, biodegradable, and composed of a renewable resource. Expandable slit sheet paper packing material is useful as a cushioning material for wrapping articles and as a void-fill material for packages. The term expanding, as used herein, refers to a three-dimensional expansion, or a volume expansion. The material expands in length and thickness while decreasing in width, to yield about a twenty-fold increase in volume and comparable decrease in density. When the slit sheet paper is stretched in a direction transverse the direction of the slits, the paper deforms, increasing in length and thickness. This stretching and increase in thickness of the slit sheet paper packing material is referred to as expansion. Slit sheet paper packing material, and the manufacturing thereof, are described in greater detail in U.S. Pat. Nos. 5,667,871 and 5,688,578, the disclosures of which are hereby incorporated herein by reference in their entireties.

SUMMARY OF THE INVENTION

While many dunnage conversion machines produce an adequate dunnage product, existing dunnage conversion machines and dunnage products are not ideal for all applications. The present invention provides a manually-operated dunnage conversion apparatus that is compact, easy to load and use, and is relatively simple and inexpensive to fabricate. The dunnage conversion apparatus can also be used with a pre-slit expandable sheet stock material to dispense an expanded dunnage product having both cushioning and void-fill characteristics.

More specifically, the present invention provides a dunnage conversion apparatus that includes a housing having an outlet opening, a support mounted in the housing and configured to support a supply of sheet stock material for dispensing in a feed direction to the outlet opening, and a pair of opposed expansion members supported in the housing for rotation about respective axes that are parallel to each other and transverse the feed direction. At least one of the expansion members is biased towards the other of the expansion members via a biasing element to grip sheet stock material fed between the expansion members.

The biasing element may be disposed about both of the expansion members.

Each expansion member of the pair of expansion members may biased toward the other of the pair of expansion members.

The biasing element may provide an equal and opposite biasing force to each of the opposed expansion members of the pair of expansion members.

The biasing element may include a first biasing element biasing the opposed expansion members together at a first end of the at least one of the expansion members and a second biasing element disposed at a second end of the at least one of the expansion members axially spaced from the first end.

The biasing element may include an elastic element.

The biasing element may include an elastic band.

The elastic band may encircle axial end portions of the pair of expansion members.

At least one of the expansion members may include a hollow cylinder having a first diameter disposed about a second cylinder having a second diameter that is less than the first diameter of the hollow cylinder.

Each of the expansion members may have a cylindrical shape.

Each of the expansion members may be made of paperboard.

The dunnage conversion apparatus may further include a supply of sheet stock material within the housing, the supply of sheet stock material including a sheet material having a plurality of slits configured to expand under tension applied in a feed direction that is transverse a length dimension of the slits.

The supply of sheet stock material may include the plurality of slits arranged in a plurality of longitudinally-spaced rows that extend in a direction transverse the feed direction.

The dunnage conversion apparatus may further include a supply of separator sheet material supported in the housing.

The biasing element may be made of an elastic material and the remainder of the apparatus may be made of recyclable, biodegradable, and renewable materials.

The present invention also provides a dunnage conversion machine that includes a housing assembly, a supply support coupled to the housing assembly for supporting a supply of sheet stock material, and a pair of opposed expansion members downstream of the supply support extending between opposed axial ends. The expansion members are rotatably coupled to the housing assembly for rotation about respective opposed axes. Sheet stock material is drawn from the supply of sheet stock material between the expansion members. A biasing element is coupled to at least one of the expansion members to bias the at least one of the expansion members towards the other of the expansion members to maintain a consistent gripping force on the sheet stock material drawn between the expansion members, where the pair of opposed expansion members and biasing element are configured to provide equivalent force at opposed lateral sides of the sheet stock material drawn between the expansion members.

The biasing element may be disposed about each of the expansion members of the pair of expansion members.

The dunnage conversion apparatus may further include another biasing element coupled to the at least one of the expansion members, such that the biasing element and the another biasing element are oppositely disposed at the opposed axial ends of the at least one of the expansion members.

The biasing element may be an elastic band that encircles axial end portions of the pair of expansion members.

The present invention further provides a method of manually dispensing an expanded slit sheet stock material. The method uses a dunnage conversion apparatus including a housing assembly, a supply of expandable sheet stock material supported on a supply support coupled to the housing assembly, and a pair of opposed expansion members downstream of the supply support for gripping the sheet stock material drawn between the expansion members. The method includes the steps of (a) pulling the sheet stock material at a location adjacent an output of the apparatus in a direction outwardly from the apparatus, (b) maintaining consistent gripping force on each of opposed lateral sides of the sheet stock material drawn between the expansion members, and (c) expanding the expandable sheet stock material via tension between the pulling force at the output and the gripping force applied to the sheet stock material by the expansion members.

The present invention also provides a dunnage conversion apparatus that includes a housing assembly, a support means coupled to the frame for supporting a supply of expandable sheet stock material, a gripping means downstream of the supply support for applying a gripping force to sheet stock material as it is drawn from the supply, and a biasing means coupled to the gripping means for biasing the gripping means in a state providing uniform expansion of the sheet stock material as it is tensioned between the gripping means and a pulling force downstream of the gripping means.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

The annexed drawings, which are not necessarily to scale, show various aspects of the disclosure.

DETAILED DESCRIPTION

The present invention provides an improved low-cost apparatus for manually converting a supply of slit sheet material into an expanded dunnage product while facilitating uniform expansion under constant tension, in a simple and easily manufactured assembly.

Figure 14:
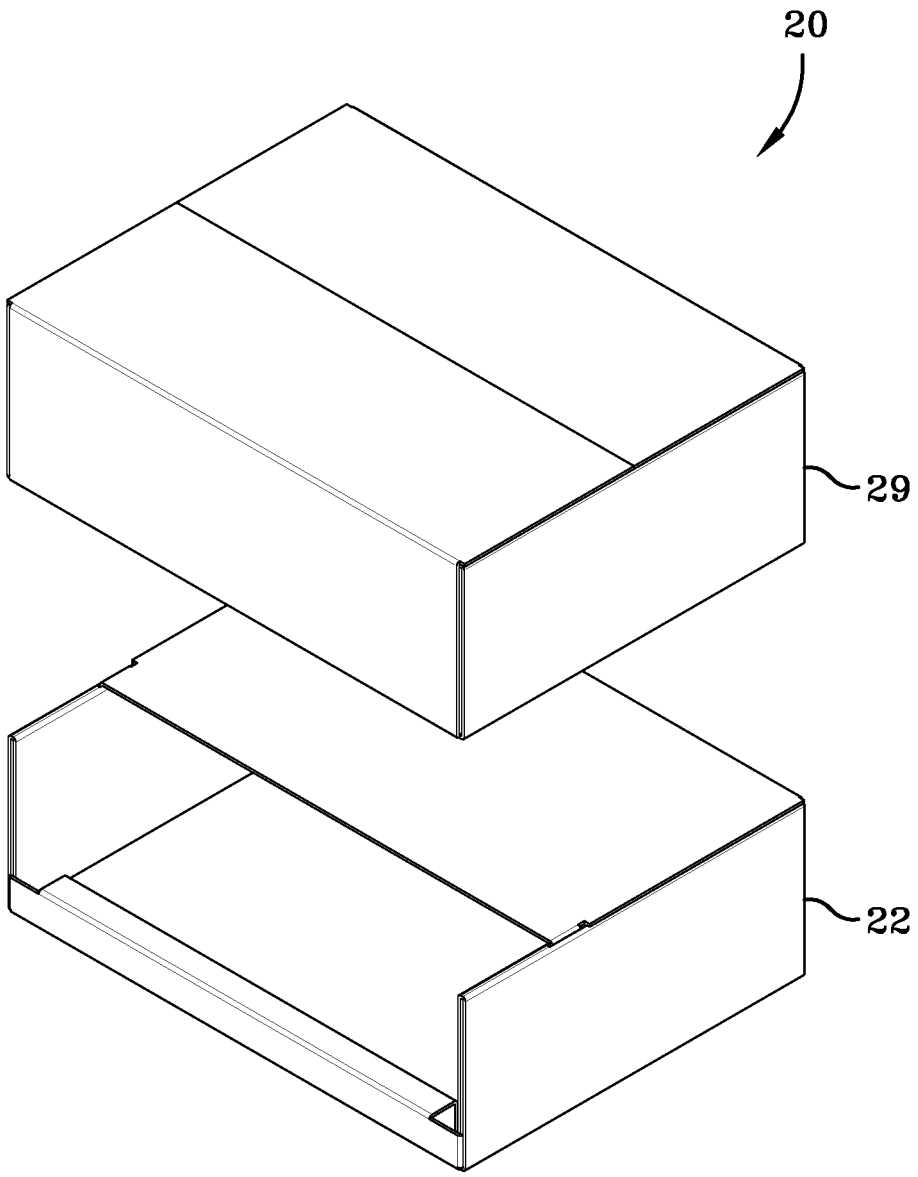
FIG. 14 is a perspective view of a cover for a dunnage conversion apparatus provided by the invention.

Referring now to the drawings in detail, FIGS. 1 to 14 illustrate an exemplary dunnage conversion machine or apparatus 20. The dunnage conversion apparatus 20 includes a housing 22 and means for supporting 23 a supply 24 of unexpanded slit sheet stock material 26 within the housing 22. The apparatus 20 also includes means for gripping 27 the sheet stock material 26 downstream of the supporting means 23 for applying a consistent gripping force to the unexpanded slit sheet material 26 as it is drawn from the supporting means 23. The gripping means 27 facilitates uniform expansion of the sheet material 26 in length and thickness as it is tensioned between the gripping means 27 and a manual pulling force downstream of the gripping means 27. The supply 24 of sheet stock material includes a slit sheet stock material 26 that expands in length and thickness when pulled from the supply 24 to form a relatively less dense, expanded dunnage product 28 (FIG. 14). As further explained below, the conversion apparatus 20 enables an operator to manually produce an expanded dunnage product 28 from the relatively more compact slit sheet stock material 26 at a lower cost than a powered dunnage converter.

The housing 22 is generally rectangular, and defines a closed volume for receipt of the supply of sheet stock material 24, the supporting means 23 and the gripping means 27. The housing 22 may be made of cardboard, or alternatively, may be made of another form of paper, such as paperboard. The housing 22 also may include means for holding the housing 22 in place during use, such as one or more strips of double-sided adhesive tape secured to a bottom side of the housing 22 and covered with a removable release liner until ready for use. The adhesive tape or other holding means helps to hold the container to a packaging surface, such as a table top, during use. This is particularly helpful when the supply 24 of sheet stock material 26 is nearly exhausted, reducing the weight of the apparatus 20 and its resistance to a pulling force on the sheet material 26.

The supporting means 23 includes one or more supports 30 positioned within the housing 22 to support or guide the sheet stock material 26 as it is drawn from the supply 24. The housing 22 has an outlet opening 32 through which the sheet stock material 26 may be drawn, the sheet stock material 26 expanding as it is drawn from the supply 24 through the gripping means 27.

Figure 15:
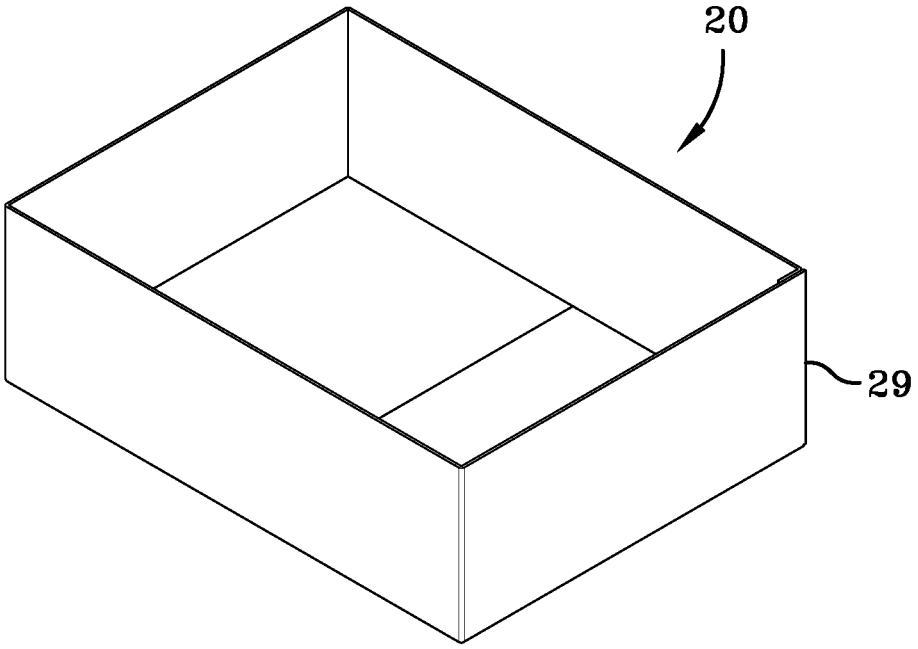
FIG. 15 is another perspective view of a cover for a dunnage conversion apparatus provided by the invention.
Figure 16:
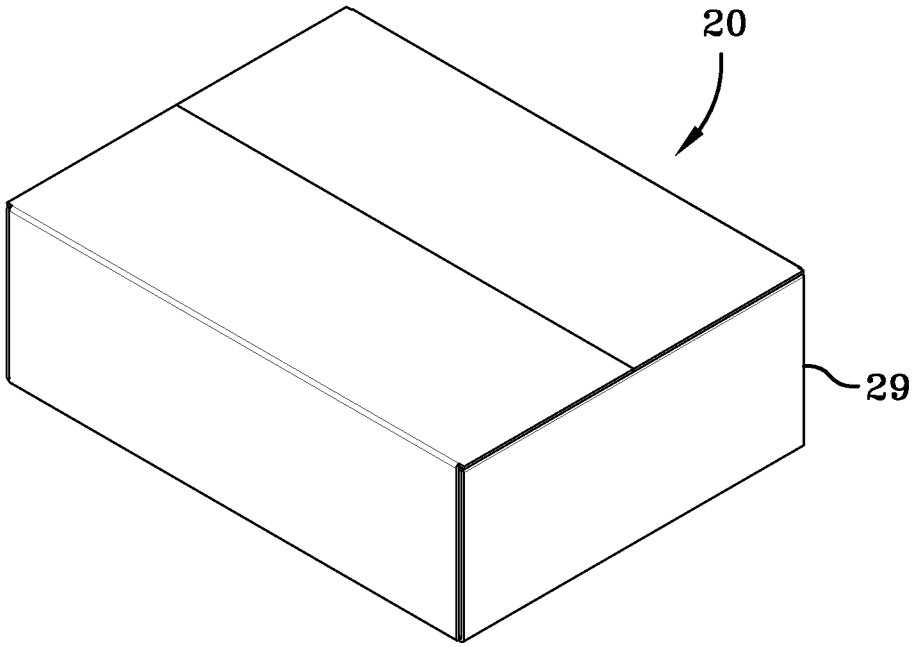
FIG. 16 is yet another perspective view of a cover for a dunnage conversion apparatus provided by the invention.

A cover or lid 29, such as that shown in FIGS. 14-16, may be provided to further protect the apparatus 20 during shipment and storage, and removed during use. The cover 29 can be made of the same material as the housing 22, such as cardboard or paperboard, and covers a top and at least a portion of the sides of the housing 22.

In other embodiments, the cover 29 may also cover at least a portion of a bottom of the housing 22. For example, a cover 29 may cover a top of the housing 22, the sides of the housing 22, and at least a portion of a bottom of the housing 22.

Figure 17:
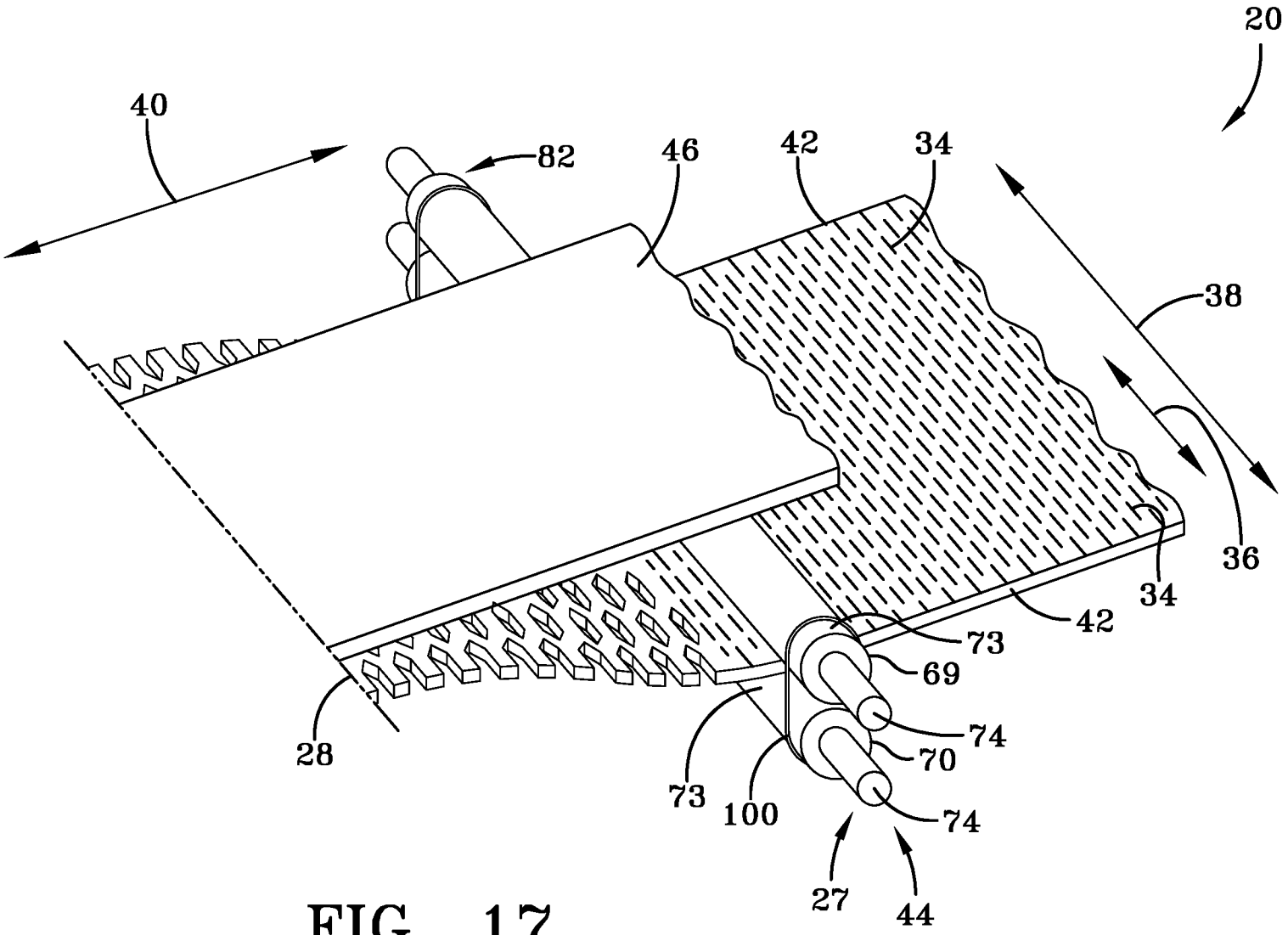
FIG. 17 is a schematic representation of a slit sheet stock material provided by the invention, illustrating the expansion of the sheet to an expanded dunnage product.

Referring briefly to FIG. 17, the sheet stock material 26 has a plurality of rows of slits 34 (FIG. 17), and typically includes one or more plies. The slits 34 have a length dimension 36 that generally is parallel to a width dimension 38 of the sheet stock material 26, transverse to a feed direction 40 from which the sheet stock material 26 is pulled from the supply 26. The feed direction 40, from the supply 24 to the outlet opening 32 through which the sheet stock material 26 is pulled, also may be referred to as a downstream direction. An upstream direction is opposite the downstream direction.

Turning again to FIGS. 1-13, as shown, the sheet material 26 generally may be supplied in one or more rolls. The sheet material 26 in each roll may be wound about a hollow core that may be received on a respective supply support 30, such that the sheet stock material 26 may rotate about a central axis 42 (FIG. 10) parallel to the width dimension 38 as the sheet material 26 is unwound from the roll in a feed direction 40 transverse the central axis 42. The hollow core may be made of paperboard. In other embodiments the supply 24 of sheet material 26 may be additionally or alternatively provided in another suitable arrangement, such as in a fan-folded stack, where the sheet stock material is alternatingly folded into a stack of generally rectangular pages with the slits generally parallel to fold lines in the sheet material.

An exemplary sheet material 26 includes paper, such as kraft paper, and more particularly, includes a single-ply kraft paper. Suitable kraft paper may have various basis weights, such as twenty-pound or forty-pound, for example. In some embodiments, the sheet material 26 may be laminated or may include any other suitable material such as another paper, plastic sheets, metal foil, or any combination thereof.

As mentioned above, an exemplary sheet material 26 has a plurality of longitudinally-spaced, transversely-extending rows of slits 34 cut into the sheet. Typically, the slits 40 are periodically, and typically equally, spaced from one another. Though in other embodiments the rows may be otherwise suitably arranged relative to one another. The slits 34 are intermittently dispersed across the rows, with the slits of each row generally being staggered in relation to slits of directly adjacent rows. Across each row of slits, there may be a greater length of combined slits than a length of un-slit portions disposed between slit endpoints, providing for an optimum amount of expansion of the slit sheet material 26.

More particularly, the exemplary sheet material 26 with its plurality of slits 34 (FIG. 17) is configured to expand along the feed direction 40 as it travels through the housing 22. As it expands, the sheet material adjacent an upstream side of the slit separates from the sheet material adjacent a downstream side of the slit, and the sheet material between the slits typically twists and extends out of the plane of the formerly planar sheet. The slits 34 may be formed by cutting the sheet material, or otherwise weakening the sheet material intermittently in a lateral direction along each row across the sheet material so that the sheet material separates across the slit under longitudinal tension provided in the feed direction 40, which is the direction of advancement of the sheet material 26 from the supply 24 to the outlet opening 32 and out of the housing 22. The lateral direction is transverse the feed direction 40 of the material 26 as it moves through the housing 22. The apparatus 22 provided by the invention may be used with a supply 24 of sheet stock material 26 with a different arrangement of slits, however.

This exemplary slit sheet material 26 is configured for expanding in one or more dimensions, also herein referred to as volume expansion or volumetric expansion. When the sheet material 26 is stretched in a direction transverse the direction of the slits, typically in a longitudinal feed direction, perpendicular to a width dimension of the roll of sheet material 26, the paper's longitudinal length and its thickness increase, while the paper's lateral width dimension decreases. The increased thickness as the sheet material 26 is stretched longitudinally is caused at least in part via portions of the sheet material 26 between the rows of slits rotating relative to the plane of the unexpanded sheet material 26. The thickness dimension extends in a normal direction relative to a face of the sheet material. The normal direction is defined as generally orthogonal to the paper's longitudinal length and also generally orthogonal to a lateral extent between lateral edges 42 (FIG. 17) of the sheet material.

The thickness of the slit sheet material 26 can increase by an order of magnitude, or more, relative to its original thickness, when stretched in this manner. The expanded slit sheet material 26 has an increased length and thickness and reduced width as compared to the unexpanded slit sheet material 26. This longitudinal stretching and increase in thickness, in addition to the random crumpling of the paper to be further explained, results in the volumetrically expanded dunnage product. The increased volume allows the expanded dunnage product to serve as a perforate protective void-fill or cushioning wrap for packaging articles in containers.

As mentioned above, the housing 22 includes one or more means for supporting sheet material 23, such as one or more supply supports 30. The apparatus further includes means for gripping 27 and thereby tensioning the sheet material 26 as it is drawn from the one or more supply supports 30. The gripping means 27 may include the illustrated expansion assembly 44. The expansion assembly 44 is spaced downstream of the one or more supply supports 30.

The unexpanded slit sheet material 26 is fed from the expandable material supply 24 in a downstream feed direction 40 through the expansion assembly 44 toward the outlet opening 32 in the housing 22. A pulling force manually applied by the operator cooperates with the expansion assembly 44 to cause the unexpanded (and expandable) material 26 to be stretched and expanded in length and thickness. When stretched, the slits 34 expand, with material on opposing sides of the slits being pulled apart, and at least a portion of the un-slit portions rotating out of the general plane of the sheet material. As described, the material expands both in thickness and in length, and thus the unexpanded slit sheet material 26 converts to the resultant expanded form of expanded slit sheet packaging dunnage material 28 (FIG. 17).

The sheet material 26 typically is drawn manually through the expansion assembly 44 and out of the housing 22, such as via an operator grasping and pulling manually on the expanded material at the output opening 32. The apparatus 20 also includes guide means 101, which may include the illustrated guide member 102 disposed downstream of the expansion assembly 24 for guiding the sheet material from the outlet opening 32 in the housing 22, to be further discussed.

Figure 1:
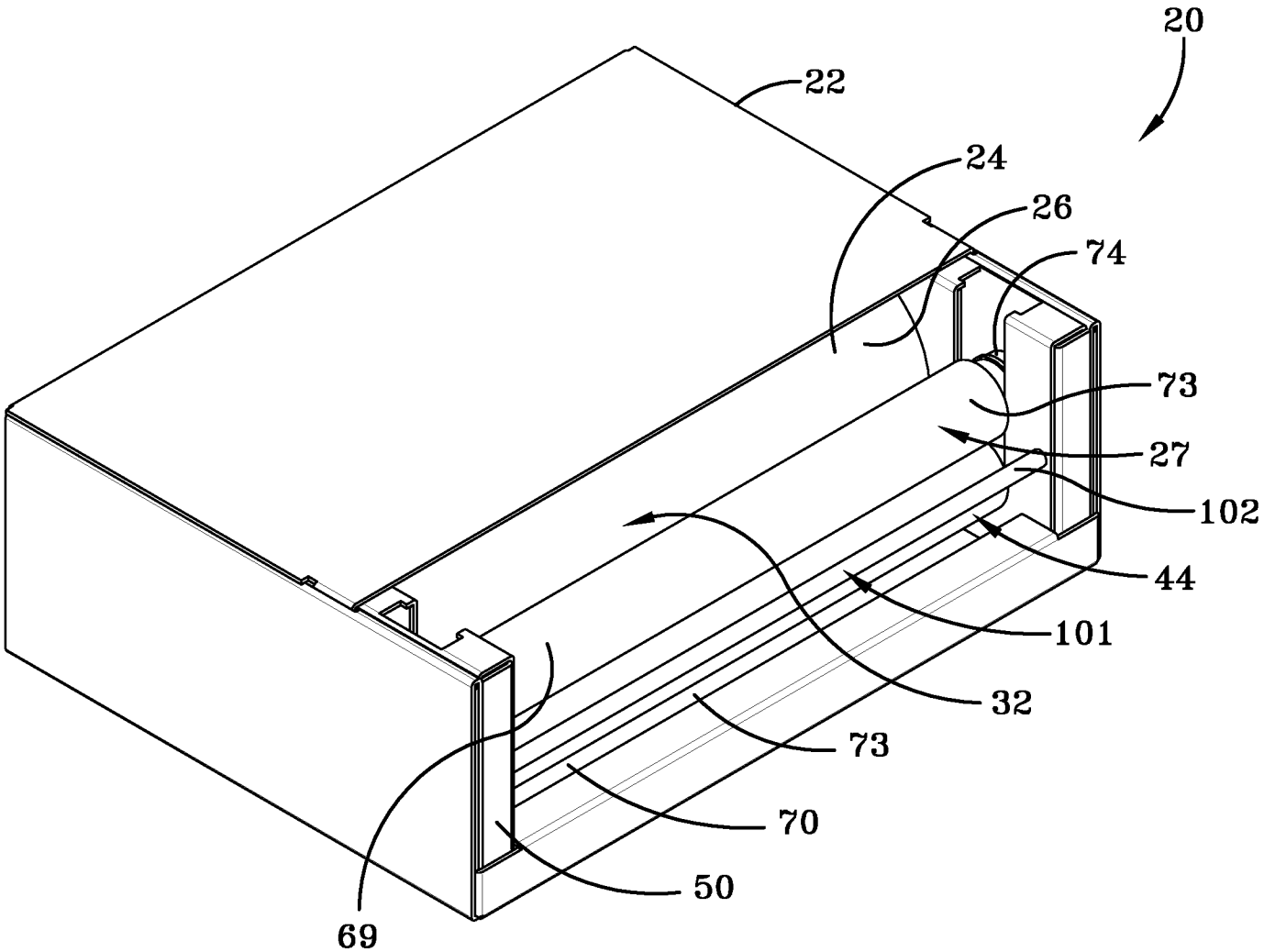
FIG. 1 is a front orthogonal view of an exemplary dunnage conversion apparatus provided in accordance with the present invention.
Figure 2:
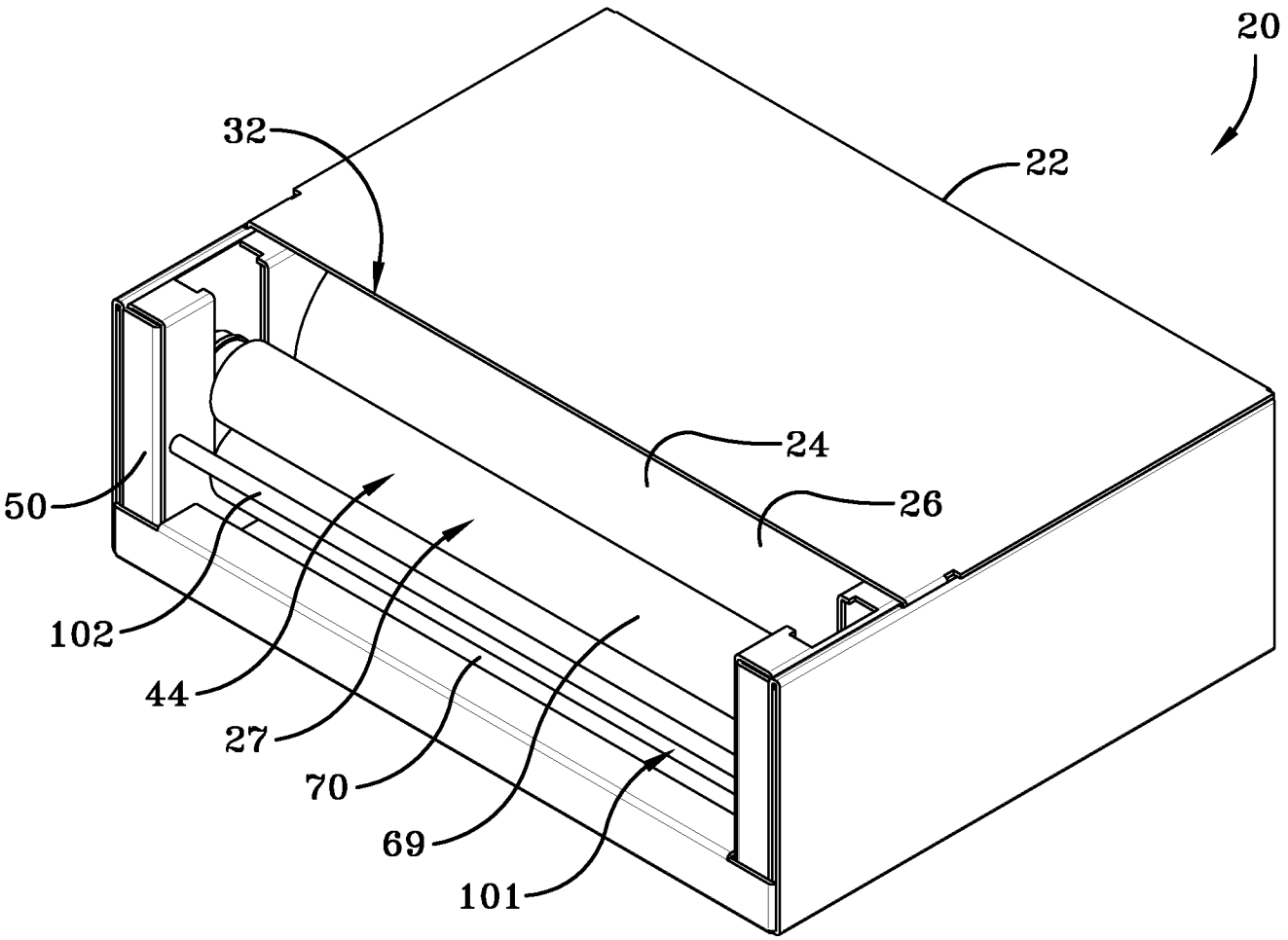
FIG. 2 is another front orthogonal view of the exemplary dunnage conversion apparatus of FIG. 1.
Figure 3:
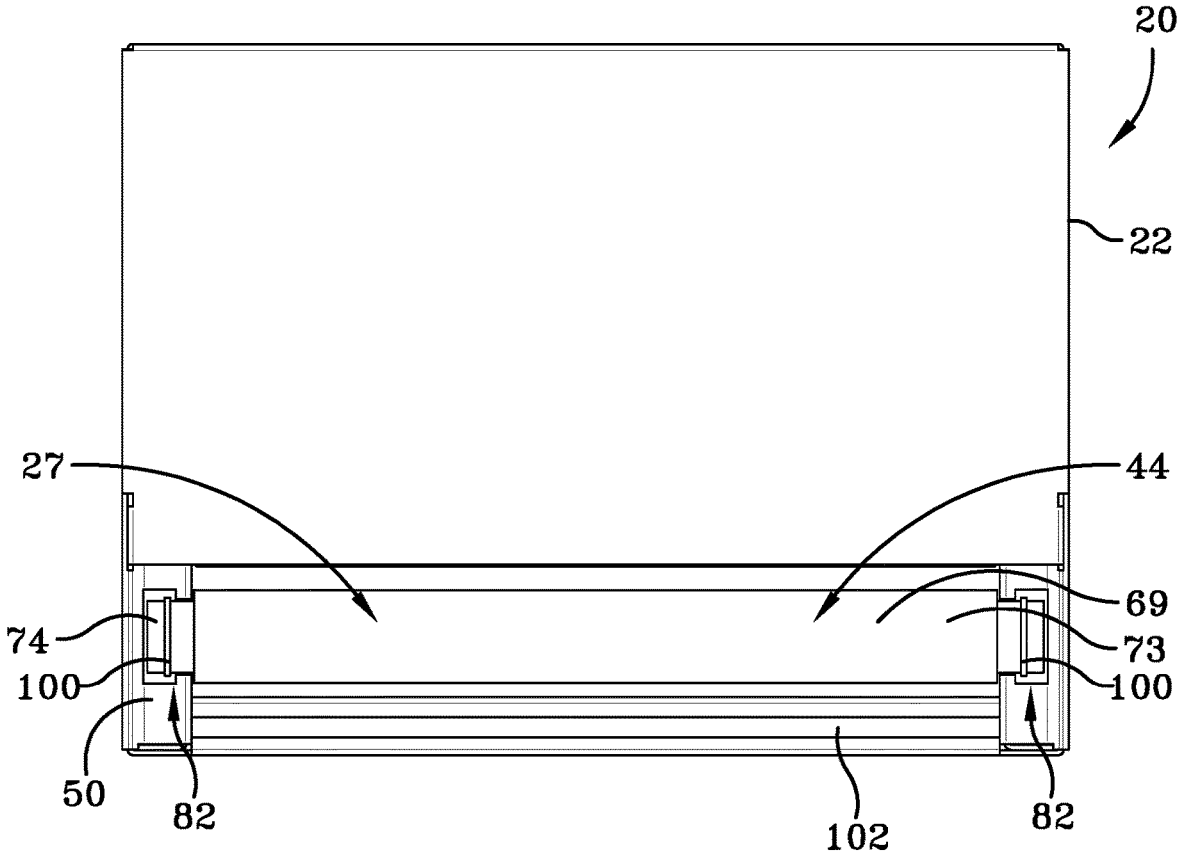
FIG. 3 is a top view of the exemplary dunnage conversion apparatus of FIG. 1.
Figure 4:
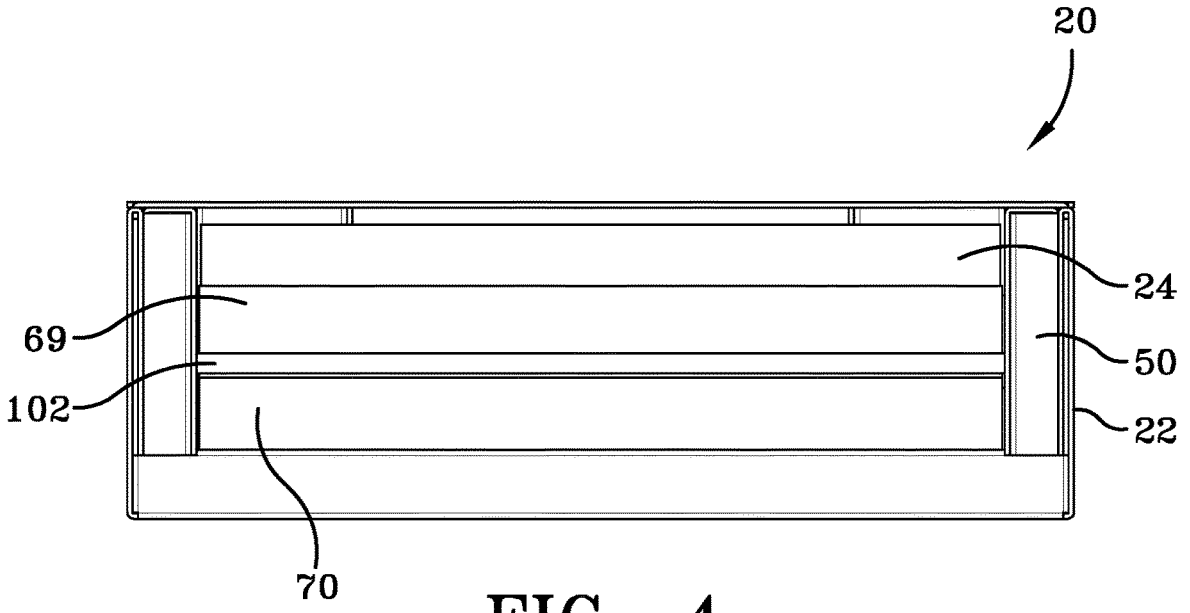
FIG. 4 is a front view of the exemplary dunnage conversion apparatus of FIG. 1.
Figure 5:
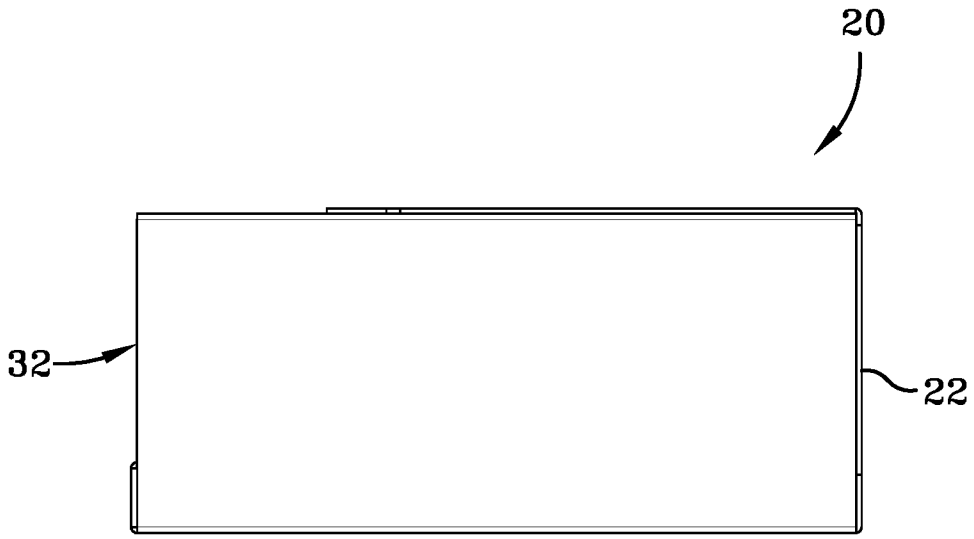
FIG. 5 is a side view of the exemplary dunnage conversion apparatus of FIG. 1.
Figure 6:
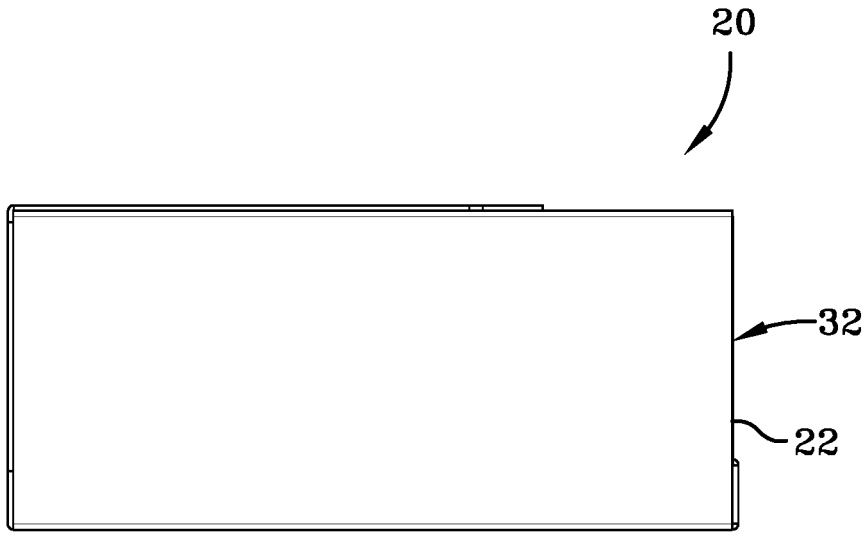
FIG. 6 is another side view of the exemplary dunnage conversion apparatus of FIG. 1.
Figure 7:
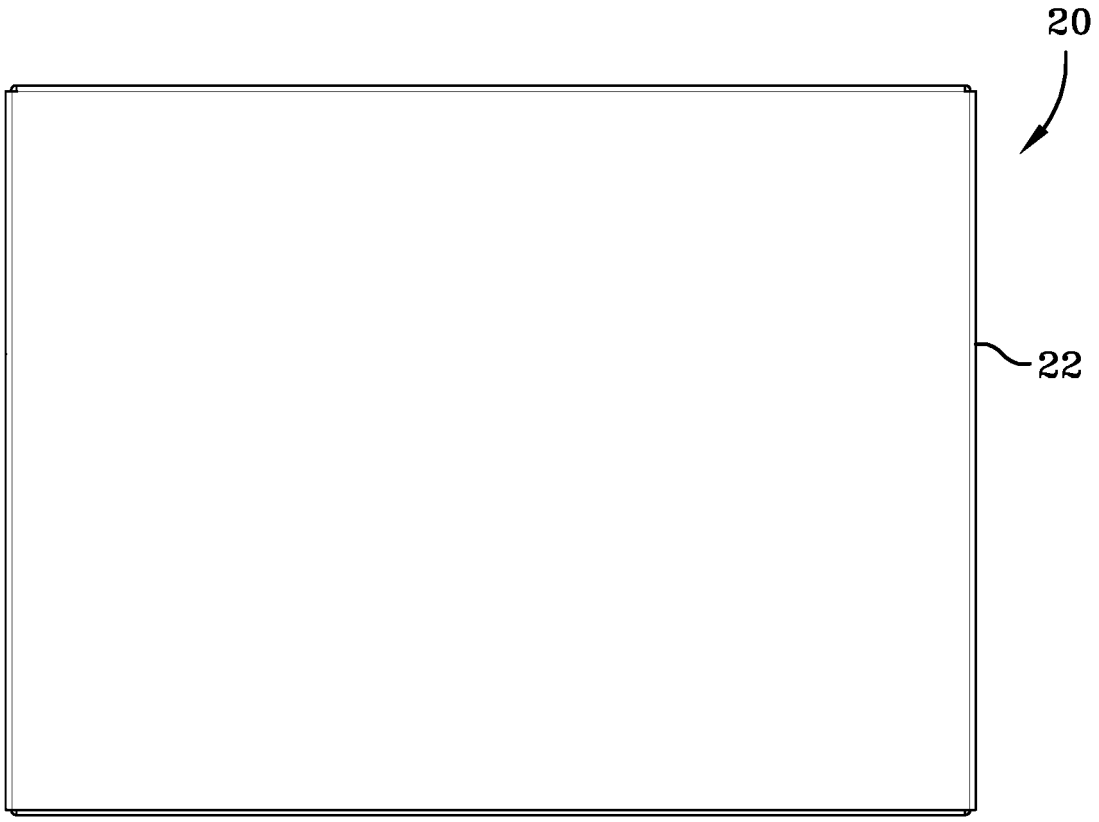
FIG. 7 is a bottom view of the exemplary dunnage conversion apparatus of FIG. 1.
Figure 8:
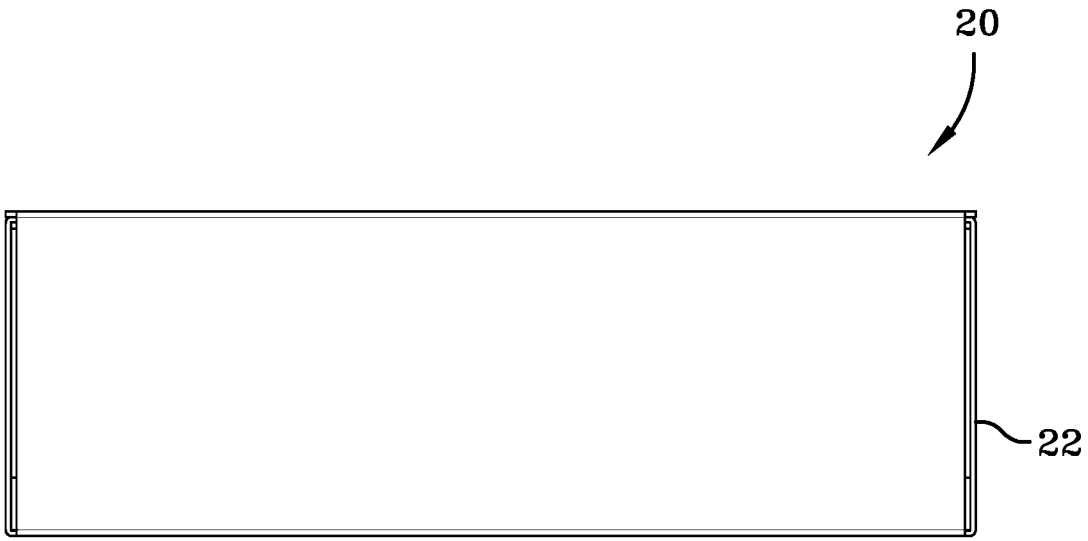
FIG. 8 is a rear view of the exemplary dunnage conversion apparatus of FIG. 1.
Figure 9:
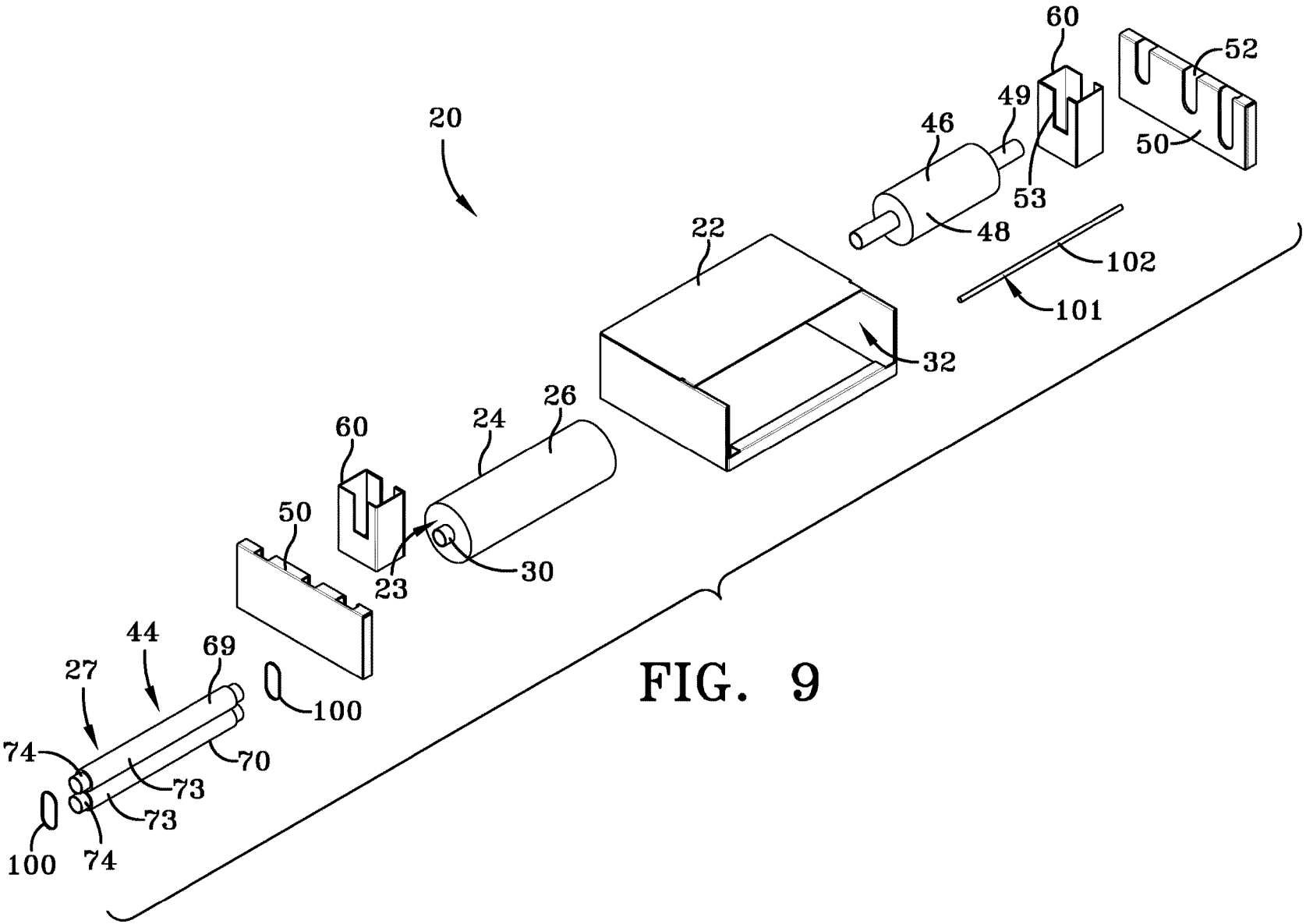
FIG. 9 is a partial exploded assembly view of the exemplary dunnage conversion apparatus of FIG. 1.

An exploded view of an exemplary apparatus 20 is shown in FIG. 9 and sequentially re-assembled in FIGS. 10-13. The housing 22 receives the other components of the apparatus 20, including the supporting means 23, a supply of sheet stock material 26, a supply of non-expandable interleaf sheet material 46, the gripping means 27, and the guide means 101.

Figure 11:
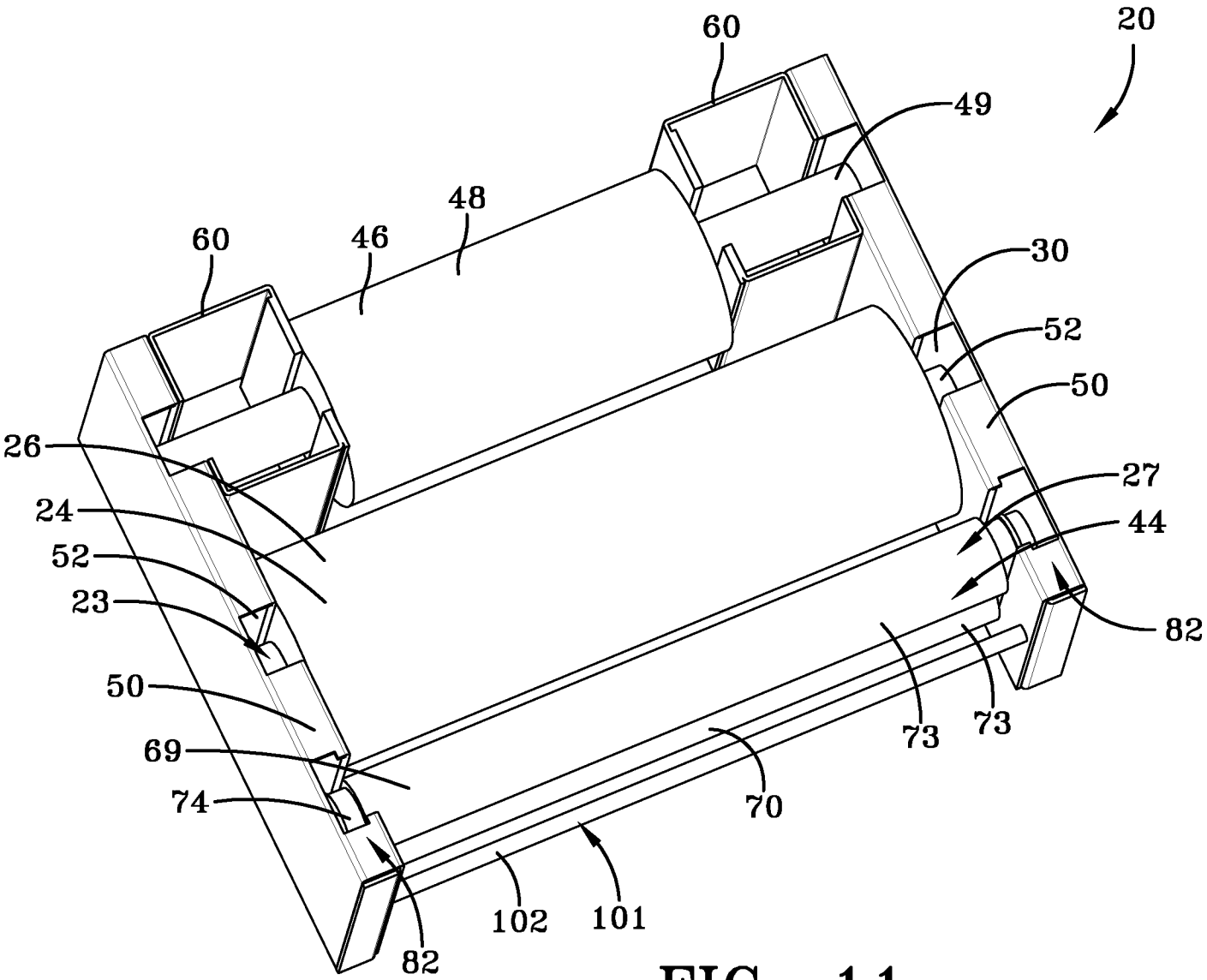
FIG. 11 is a partial orthogonal view of the exemplary dunnage conversion apparatus of FIG. 1 with the housing removed.
Figure 12:
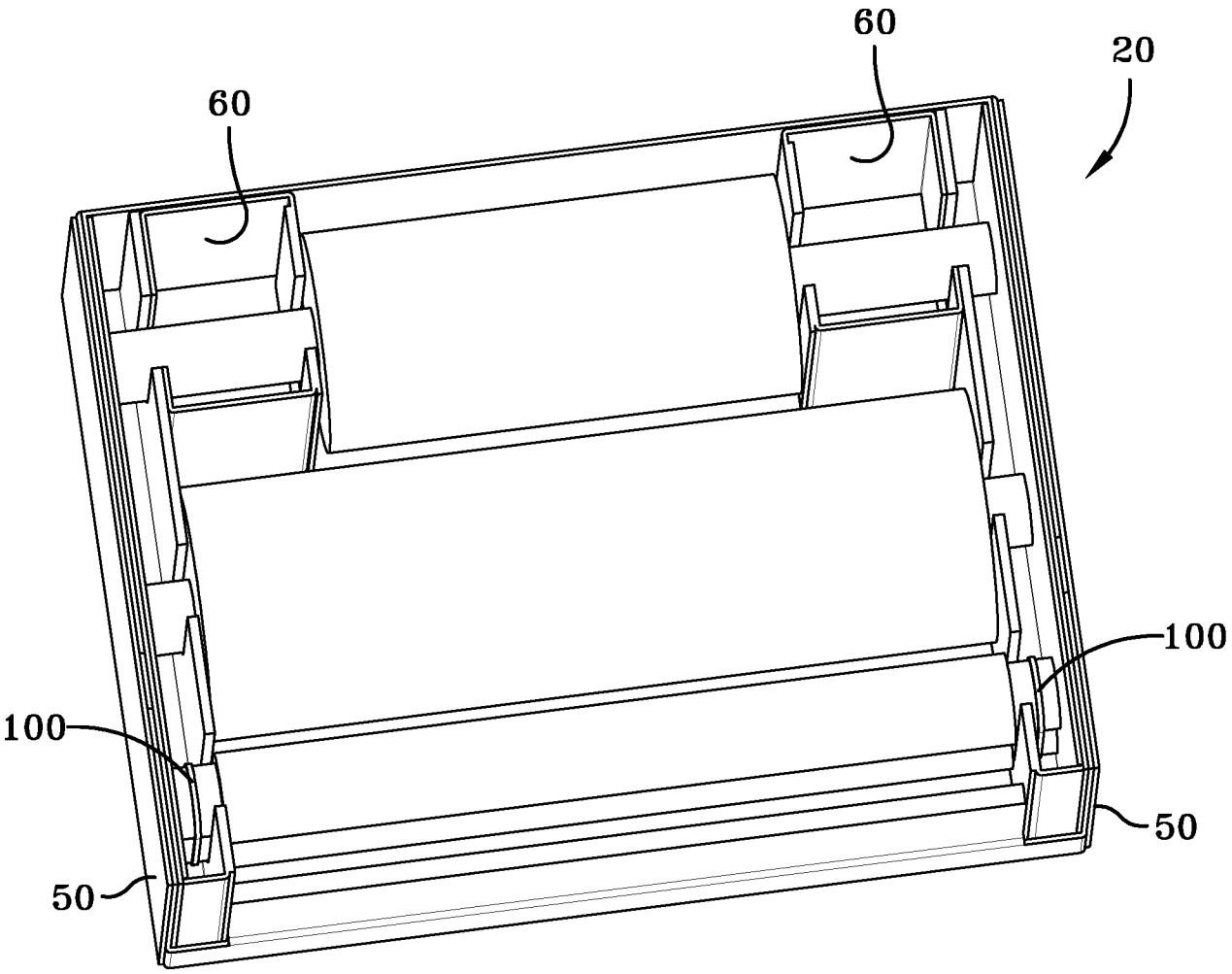
FIG. 12 is another partial orthogonal view of the exemplary dunnage conversion apparatus of FIG. 1 with the housing removed.
Figure 13:
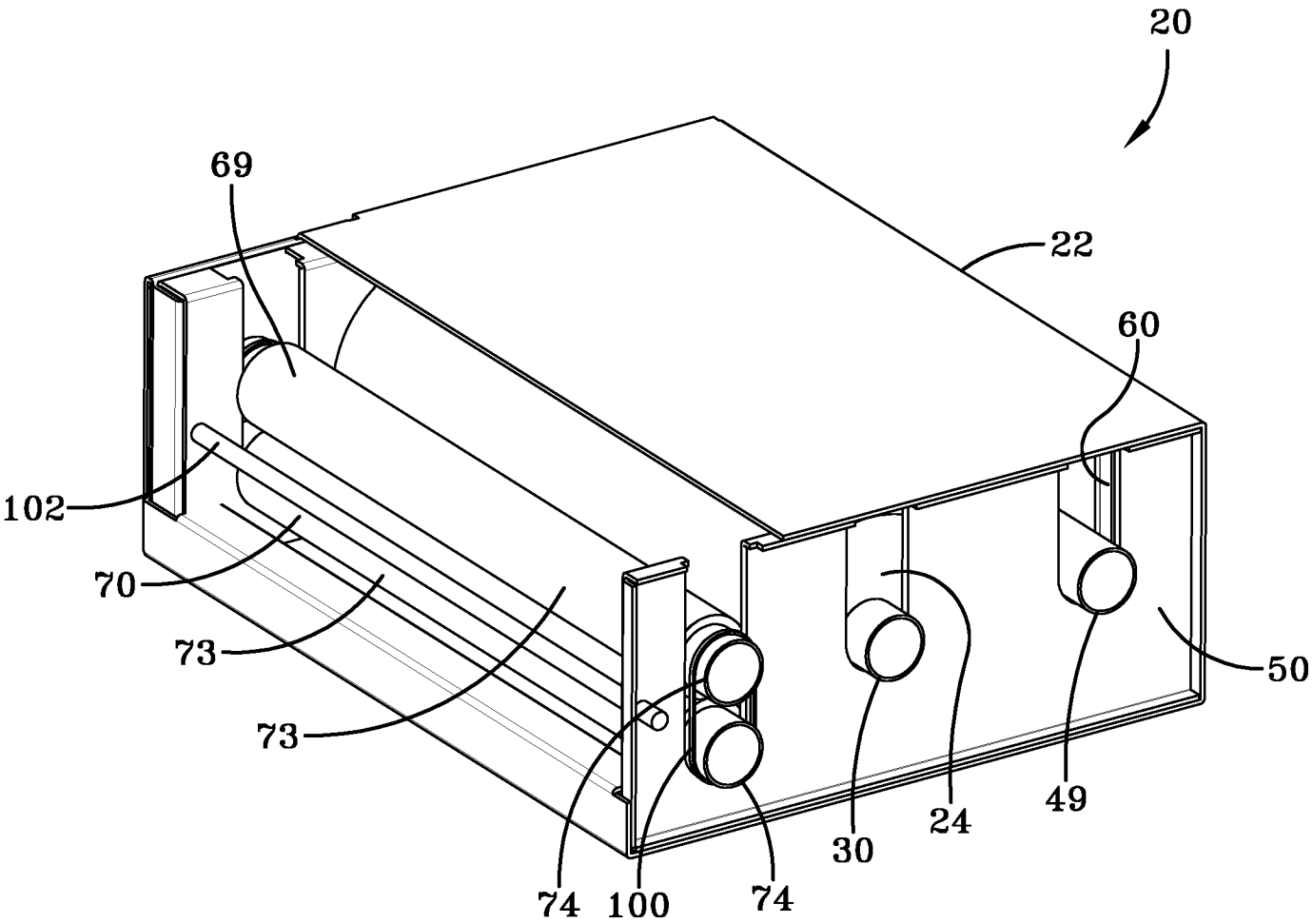
FIG. 13 is a perspective view of the exemplary dunnage conversion apparatus of FIG. 1 with a portion of a side wall of the housing removed.

The stock material supporting means 23, including the support 30, generally also is formed of cardboard or other paper-based product. In the illustrated embodiment, the support 30 is supported on laterally-spaced, vertically-extending side frames 50 (FIG. 11). The side frames 50 may be coupled to one another via a base portion or one or more cross-beams or may be separate components. The side frames 50 are shown as separate components but may be integral with the housing 22 in other embodiments. Accordingly, the support 30 and side frames 50 can be a single, unitary structure, or can be formed of separate components as shown, but jointly typically bound the path of the sheet material 26 from the sheet stock material support 30 to the outlet opening 32 in the housing 22.

The side frames 50 include vertical slots 52 (FIG. 11) extending from an upper edge to receive and support lateral ends of various rotatable members, including rolls of sheet stock material 26 and rotatable elements for the expansion assembly 44. The side frames 50 may also receive and support the guide member 102. The side frames 50 are mounted adjacent opposing inside side walls of the housing 22, with the slots 52 of the respective side frames 50 facing inwardly, toward the other side frame 50.

In other embodiments, the side frames 50 may be omitted, and any of the support 30, the expansion assembly 44, and the guide member 102 may be supported on the housing 22. In even other embodiments where the supply 24 includes a fan-folded stack of paper, the supply support 30 may include a shelf for supporting the fan-folded stack of paper as it is drawn from the shelf. The shelf may cooperate with the frame sides 50 to support the stack of paper and guide the paper from the stack towards the expansion assembly 44.

Figure 10:
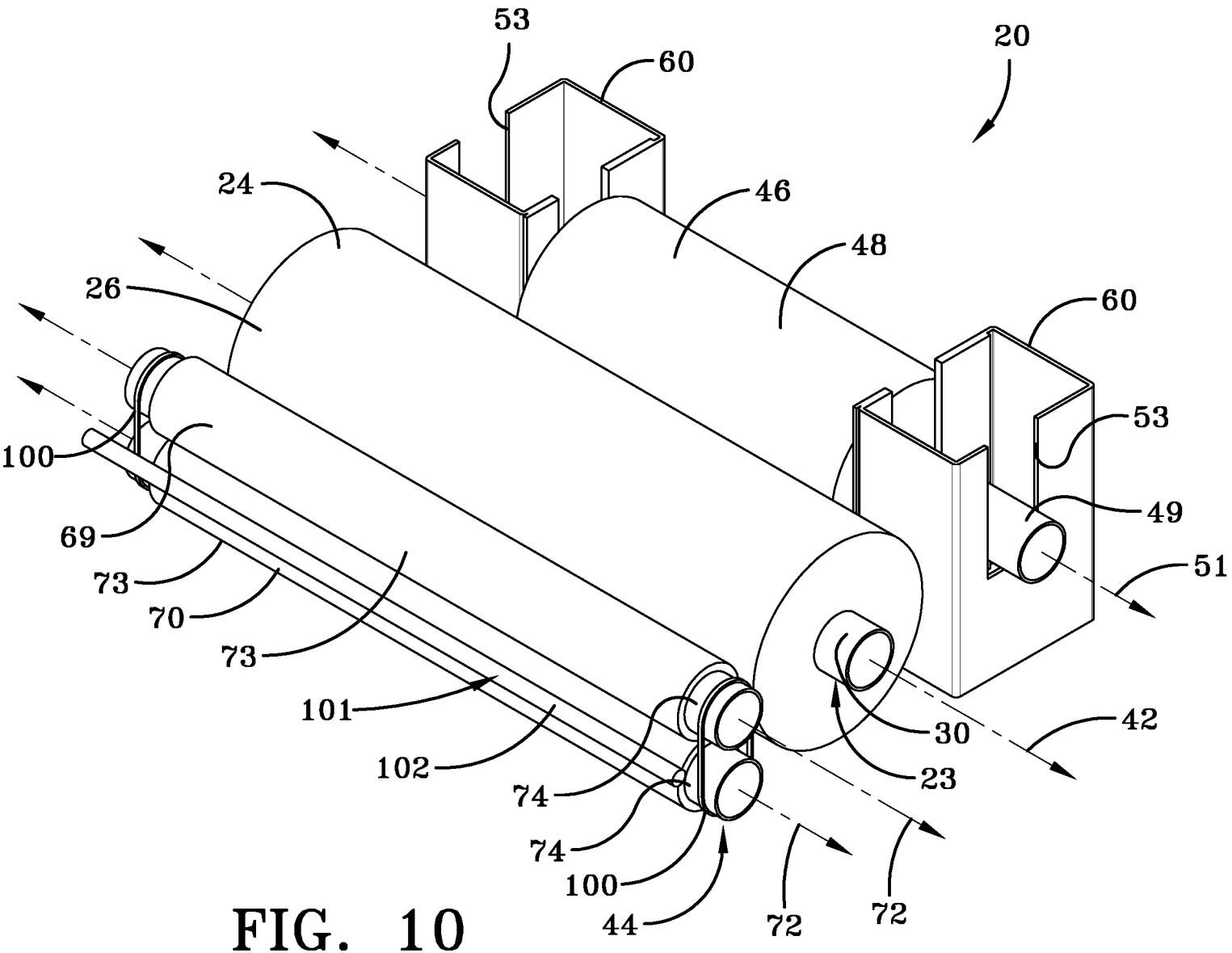
FIG. 10 is a partial orthogonal view of the exemplary dunnage conversion apparatus of FIG. 1 with the housing removed to more clearly see the internal components of the apparatus.

Referring briefly to FIGS. 9 and 10, the apparatus 20 may further include a separator supply 46 of separator sheet material 48 for use as a separator sheet between the resultant dunnage product 28 and a product to be protected by the dunnage product 28. An exemplary separator sheet material 48, also herein referred to as interleaf paper, may be a tissue paper, thin kraft paper such as thinner than the slit sheet stock material 26, plastic, a combination thereof, etc.

Like the supply 24, the separator supply 46 may be provided as a roll, such as wound about a hollow core that may be received on a respective supply support. The roll of separator sheet material 48 generally may be supplied on one or more supports 49. For example, as illustrated, the separator sheet material 48 may be wound about a hollow core that may be received on a respective supply support 49, such that the separator supply 46 may rotate about a central axis 51 (FIG. 10) as the separator sheet material 48 is unwound from the roll in a feed direction 40 transverse the central axis 51. Additionally or alternatively, the separator supply 46 may be provided in a fan folded stack, and an associated supply support may include a shelf for supporting the stack.

One or more additional guide portions, such as guide blocks 60, may be provided for aligning and guiding the support 49, and thus the separator supply 46, between the side frames 50. The guide blocks 60 may be made of cardboard. As depicted, exemplary guide blocks 60 may each include a slot 53 for receiving the support 49. The guide blocks 60 are provided adjacent the supply of non-slit interleaf sheet material 46, which has a narrower width than the slit sheet material 26. Because the slit sheet stock material 26 narrows in width during expansion, and the interleaf sheet material 46 does not expand or change its dimensions, the interleaf material 46 can be provided in a form with a narrower width at the outset. The guide blocks 60 help to center the narrower interleaf sheet material 46 relative to the supply of slit sheet stock material 26. In other embodiments, the guide blocks 60 may be omitted and the supply 46 may be supported on the side frames 50 or the housing 22.

The guide blocks 60 may be of any suitable shape. The illustrated pair of laterally-spaced guide blocks 60 are positioned laterally adjacent axially-opposed ends of the interleaf sheet material 46, upstream of the slit sheet stock material 26. The guide blocks 60 are located generally upstream of the expansion assembly 44, to assist in maintaining lateral centering alignment of the roll of interleaf sheet material 46 between the side frames 50. This centering aids in preventing jamming of sheet material between the supply 24 and the expansion assembly 44. The guide blocks 60 additionally or alternatively may aid to prevent or minimize binding between the supply support 22 and the side frames 50.

Referring now to the means for gripping 27 in detail, the means for gripping 27 the sheet material 26 drawn from the roll may include the expansion assembly 44, as previously indicated. The expansion assembly 44 is located downstream of the supply support 22. The expansion assembly 44 includes a pair of adjacent expansion members 69 and 70 coupled, such as rotatably coupled, to the frame 20 for rotation about respective expansion axes 72 (FIG. 10). The sheet stock material 26 is gripped between the expansion members 69 and 70 while being drawn through the expansion assembly 44. Further, although a single pair of expansion members 69 and 70 is depicted, additional expansion members 69 or 70 or pairs of expansion members may be included.

In the illustrated embodiment, the expansion members 69 and 70 are mounted in a common slot 52 in the upright side frames 50. In this way, the expansion axes 72 are aligned generally parallel to one another, though the axes 72 may not be exactly parallel. In the depicted embodiment, the expansion axes 72 are aligned with one axis 72 aligned vertically above the other axis 72 such that the axes 72 are in a common vertical plane. The axes 72 of the expansion members 69 and 70 should be parallel to each other, but are not necessarily in a vertical plane. For example, in other embodiments, one of the axes 72 may be slightly forward (downstream) or behind (upstream) the other of the axes 72.

The expansion members 69 and 70 are closely spaced to engage the relatively thin unexpanded sheet material 26. At least a portion of each expansion member 69 and 70 may engage the other of the expansion members 69 and 70, particularly when the slit sheet material 26 is absent. The expansion members 69 and 70 may be made of recyclable material, such as paperboard.

The illustrated expansion members 69 and 70 each include complimentary rollers, such as cylindrical hollow rollers. As shown, each member 69 and 70 includes a smaller diameter, longer cylindrical core roller 74 that extends into the slots 52 in the side frames 50, and a larger diameter, shorter cylindrical outer roller 73 disposed around the core roller 74. The outer rollers 73 are received between the side frames 50 and extend substantially the full width of the distance between the frame sides 50.

Accordingly, one or more of the depicted outer rollers 73 of the expansion members 69 and 70 is supported on a core roller 47 of the respective of the expansion members 69 and 70, also herein referred to as an expansion axle 74. The expansion axles 74 are coupled to the frame 20, such as rotatably coupled or fixedly coupled, for example via the side frames 50. The axles 74 extend along the respective expansion axes 72. In summary, the expansion members 69 and 70 may each include a radially outer rotatable member, such as a hollow cylinder, disposed about a radially inner rotatably member, such as an axle 74, which likewise may be a hollow cylinder. It will of course be appreciated that in other embodiments, one or more of the outer rollers 73 and the associated axle 74 may be integral with one another, or the axle 74 may be omitted where suitable.

The expansion assembly further includes biasing members 100 for biasing each of the expansion members 69 and 70 towards the other of the expansion members 69 and 70. Generally the pair of opposed expansion members 69 and 70 and the biasing members 100 are configured to provide equivalent force at the opposed axial ends of the expansion members 69 and 70 on the sheet stock material 26 drawn between the opposed expansion members 69 and 70, and uniform force across the lateral width of the sheet stock material 26 extending between the axial ends of the expansion members 69 and 70.

Exemplary biasing members 100 include elastic members, such as elastic bands. The elastic bands are generally applied to respective axially-outer portions 82, such as axially-outer ends, of the expansion members 69 and 70. As shown in FIGS. 10-13, the biasing members 100 are disposed about respective axially-outer ends of the expansion axles 74 of the members 69 and 70. In other embodiments, the biasing members 100 may be disposed about axially-outer ends of the outer rollers 73 of the members 69 and 70, such as depicted in FIG. 14.

Applying the biasing members 100 to the axially-outer portions of the expansion members 69 and 70 provides an equal biasing force at each end and thus across the width of the expansion members 69 and 70. The biasing force generally is sufficient to resist the pulling force in the downstream feed direction 40 (FIG. 14) without causing the sheet stock material 26 to tear as it is drawn through the expansion assembly 44. This arrangement allows the operator to maintain a consistent gripping force on the sheet material drawn through the expansion assembly 44.

The expansion members 69 and 70 and the biasing members 100 cooperate with one another to apply a gripping force to sheet material 26 passing between the expansion members 69 and 70 to slow the passage of the sheet material 26 therebetween. When an operator applies a force on the sheet stock material 26 by pulling the sheet material 26 in the downstream or feed direction 40, the gripping force transverse the feed direction 40 allows for expanding tension to be applied to the sheet material 26 between the expansion assembly 44 and the downstream pulling force.

In this way, as the sheet stock material 26 is drawn between the expansion members 69 and 70, the sheet stock material 26 can be gripped between the outer portions of respective ones of the expansion members 69 and 70. The outer surfaces of the expansion members 69 and 70 may be made of or coated with a material that provides sufficient friction relative to the sheet material 26 to facilitate drawing the sheet material 26 between the expansion members 69 and 70.

Finally, a guide member or guide 102, alternatively referred to as an alignment member, extending between the side frames 50 downstream of the expansion assembly 44 facilitates guiding the interleaf sheet material 46 around the expansion assembly 44 and keeping the interleaf sheet flat as it moves into an overlapping alignment with the expanded dunnage product 28. The interleaf sheet material 46 prevents or minimizes nesting interlocking of adjacent layers of expanded slit sheet stock material. The guide member 102 also may assist in maintaining tautness of the sheet material 26 and in preventing wrinkling, tearing, or misalignment of the sheet material between the side frames 50 as it is drawn from the supply 24 through the expansion assembly 44. The alignment member 102 also may serve to reduce jamming at the expansion assembly 24. In some embodiments, the guide member 102 may be a roller, such as rotatable about a central axis of the guide member 102. An exemplary alignment member 102 may include a paperboard tube or rod, or a wooden dowel.

The guide member 102 is positioned such that the dunnage product 28 is drawn under the guide member 102 to bring the expanded dunnage product 28 and the separating interleaf sheet material 46 into parallel, overlapping paths. This positioning may assist in maintaining tautness of the dunnage product 28, distributing tension across the width of the stock material, and preventing wrinkling, tearing, or misalignment of the dunnage product 28 between the side frames 50 as it is drawn from the expansion assembly 44.

Since the housing 22, the supply of sheet stock material 26 and interleaf sheet material 46, and the cores about which they are wound, the expansion members 69 and 70, and the guide member 102 are all made of paper, substantially the entire apparatus is recyclable, otherwise disposable after use, and composed of a renewable resource. The biasing members 100 can be reused or repurposed.

The present disclosure also includes a method of manually dispensing an expanded slit sheet stock material 26 as an expanded dunnage product 28. The method uses the dunnage conversion apparatus 20 having a housing assembly 22, and a supply 24 of expandable sheet stock material 26 supported on a supply support 30 coupled to the housing assembly 22. The apparatus 20 includes a pair of opposed expansion members 69 and 70 downstream of the supply support 30 for gripping the sheet stock material 26 drawn between the expansion members 69 and 70. The method includes the steps of (a) pulling the sheet stock material 26 at a location adjacent an output of the apparatus in a direction outwardly from the apparatus, (b) maintaining consistent gripping force on each of opposed lateral sides of the sheet stock material 26 drawn between the expansion members 69 and 70, and (c) expanding the expandable sheet stock material 26 via tension between the pulling force at the output and the gripping force applied to the sheet stock material 26 by the expansion members 69 and 70. The method further includes providing gripping force on the sheet stock material 26 by the expansion members 69 and 70 using a biasing element 100. A further step includes providing an equal and opposite biasing force to each of the opposed expansion members 69 and 70 of the pair of expansion members via use of biasing elements 100 disposed about each of opposite axial ends of the pair of expansion members.

In summary, the present invention provides a manually-operated dunnage conversion apparatus 20 that includes a housing 22 with an outlet opening 32, a supply 24 of slit sheet stock material 26 supported within the housing 22 for dispensing from the outlet opening 32, and a pair of opposed expansion members 69 and 70 rotatably coupled to the housing 22 for rotation about respective, parallel expansion axes 72 between the supply 24 and the outlet opening 32. The expansion members 69 and 70 are biased towards each other via a biasing member 100 to provide a gripping force on sheet stock material 26 fed therebetween to apply friction to the sheet stock material that causes the sheet stock material to expand in length and thickness as an operator pulls the sheet stock material from the outlet opening 32 in the housing 22. With the possible exception of the biasing member 100, the apparatus 20 may be made of paper-based products, making the apparatus 20 recyclable, reusable, and composed of a renewable resource, as well as inexpensive to manufacture.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A dunnage conversion apparatus, comprising:

a housing having an outlet opening;

a support mounted in the housing and configured to support a supply of sheet stock material for dispensing in a feed direction to the outlet opening;

a pair of opposed expansion members made of paper supported in the housing for rotation about respective axes that are parallel to each other and transverse the feed direction; and an elastic biasing element coupled to at least one of the pair of opposed expansion members thereby biasing the at least one of the pair of opposed expansion members towards the other of the pair of opposed expansion members to maintain a consistent gripping force on the sheet stock material drawn between the pair of opposed expansion members.

2. The dunnage conversion apparatus of claim 1, where the elastic biasing element is disposed about both of the expansion members.

3. The dunnage conversion apparatus of claim 1, where each expansion member of the pair of expansion members is biased toward the other of the pair of expansion members.

4. The dunnage conversion apparatus of claim 1, where the elastic biasing element provides an equal and opposite biasing force to each of the opposed expansion members of the pair of expansion members.

5. The dunnage conversion apparatus of claim 1, where the elastic biasing element includes a first elastic biasing element biasing the opposed expansion members together at a first end of the at least one of the expansion members and a second elastic biasing element disposed at a second end of the at least one of the expansion members axially spaced from the first end.

6. The dunnage conversion apparatus of claim 1, where the elastic biasing element includes an elastic band.

7. The dunnage conversion apparatus of claim 6, where the elastic band encircles axial end portions of the pair of expansion members.

8. The dunnage conversion apparatus of claim 1, where at least one of the expansion members includes a hollow cylinder having a first diameter disposed about a second cylinder having a second diameter that is less than the first diameter of the hollow cylinder.

9. The dunnage conversion apparatus of claim 1, where each of the expansion members has a cylindrical shape.

10. The dunnage conversion apparatus of claim 9, where each of the expansion members is made of paperboard.

11. The dunnage conversion apparatus of claim 1, further including a supply of sheet stock material within the housing, the supply of sheet stock material including a sheet material having a plurality of slits configured to expand under tension applied in a feed direction that is transverse a length dimension of the slits.

12. The dunnage conversion apparatus of claim 11, where the supply of sheet stock material includes the plurality of slits arranged in a plurality of longitudinally-spaced rows that extend in a direction transverse the feed direction.

13. The dunnage conversion apparatus of claim 12, further including a supply of separator sheet material supported in the housing.

14. The dunnage conversion apparatus of claim 1, where the elastic biasing element is made of an elastic material and the remainder of the apparatus is made of recyclable, biodegradable, and renewable materials.

15. The dunnage conversion apparatus of claim 1, where the housing is made of paper.

16. The dunnage conversion apparatus of claim 15, where each of the expansion members is made of paper.

* * * * *